US010603934B2

(12) United States Patent
Nakata

(10) Patent No.: US 10,603,934 B2
(45) Date of Patent: Mar. 31, 2020

(54) WINDING APPARATUS AND PRINTING APPARATUS

(71) Applicant: SEIKO EPSON CORPORATION, Tokyo (JP)

(72) Inventor: Toshio Nakata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 115 days.

(21) Appl. No.: 15/730,453

(22) Filed: Oct. 11, 2017

(65) Prior Publication Data

US 2018/0104969 A1 Apr. 19, 2018

(30) Foreign Application Priority Data

Oct. 19, 2016 (JP) ..... 2016-205372

(51) Int. Cl.

| | |
|---|---|
| ***B41J 15/16*** | (2006.01) |
| ***B65H 18/26*** | (2006.01) |
| ***B65H 75/28*** | (2006.01) |
| *B41J 13/22* | (2006.01) |
| *B65H 19/22* | (2006.01) |

(52) U.S. Cl.

CPC ..... *B41J 15/165* (2013.01); *B65H 18/26* (2013.01); *B65H 75/285* (2013.01); *B41J 13/223* (2013.01); *B65H 19/22* (2013.01)

(58) Field of Classification Search

CPC ..... B41J 15/165
USPC ..... 400/613
See application file for complete search history.

(56) References Cited

U.S. PATENT DOCUMENTS

| | | | | |
|---|---|---|---|---|
| 3,670,980 | A * | 6/1972 | Mukai | B65H 18/10 242/547 |
| 4,365,767 | A * | 12/1982 | Benthimere | B65H 18/103 242/530.2 |
| 4,431,140 | A * | 2/1984 | Tetro | B65H 19/2215 242/533.4 |
| 4,778,119 | A * | 10/1988 | Yamazaki | B65H 18/10 226/190 |
| 5,518,201 | A * | 5/1996 | Hagens | B65H 18/16 242/547 |
| 5,556,052 | A * | 9/1996 | Knaus | B65H 18/16 242/412.3 |
| 5,660,351 | A * | 8/1997 | Osanai | B65H 18/26 242/533.4 |
| 2007/0152095 | A1* | 7/2007 | Dumas | B65H 18/08 242/541.4 |
| 2009/0321551 | A1* | 12/2009 | Altesellmeier | B65H 18/26 242/533.4 |

(Continued)

FOREIGN PATENT DOCUMENTS

| | | |
|---|---|---|
| JP | 63-151466 | 10/1988 |
| JP | 2003-048646 | 2/2003 |
| JP | 2007-168380 | 7/2007 |

(Continued)

*Primary Examiner* — Anthony H Nguyen
(74) *Attorney, Agent, or Firm* — Workman Nydegger

(57) ABSTRACT

A winding apparatus that can restrain a medium from being wound unevenly when a long medium is wound around a winding roller and a printing apparatus that includes the winding apparatus are provided. A winding apparatus includes a winding section that has a winding roller rotatably supported therein and winds a long medium around the winding roller. The winding section also has a pressing portion that presses the medium toward the winding roller.

8 Claims, 5 Drawing Sheets

(56) References Cited

U.S. PATENT DOCUMENTS

2013/0248640 A1* 9/2013 Niwa ..... B65H 19/26
242/522

FOREIGN PATENT DOCUMENTS

| | | |
|---|---|---|
| JP | 2007-223773 | 9/2007 |
| JP | 2015-227231 | 12/2015 |

* cited by examiner

WINDING APPARATUS AND PRINTING APPARATUS

BACKGROUND

1. Technical Field

The present invention relates to a winding apparatus and a printing apparatus that includes the winding apparatus.

2. Related Art

Printing apparatuses that perform printing by ejecting ink onto a medium such as a long sheet of paper are known. An example of such printing apparatuses is a printing apparatus that includes a winding apparatus that winds a medium on which printing has been performed around a winding roller (for example, see JP-A-2015-227231). This winding apparatus controls the speed of medium transport and the speed of medium winding so as to restrain a medium from being wound unevenly with respect to the winding roller.

However, a printing apparatus as in the above example is susceptible to uneven winding due to air entering between layers of the medium wound around the winding roller, which requires further improvement.

SUMMARY

An advantage of some aspects of the invention is that a winding apparatus that can restrain uneven winding when a long medium is wound around a winding roller and a printing apparatus that includes the winding apparatus are provided.

Some aspects of the invention and advantageous effects that may be obtained will be described below. A winding apparatus according to an aspect of invention includes a winding section that has a winding roller rotatably supported therein and winds a long medium around the winding roller and also includes a pressing portion that presses the medium toward the winding roller.

In accordance with this configuration, the pressing portion presses the medium toward the winding roller that winds up the medium. As a result, air does not easily enter between layers of the medium that has been wound around the winding roller. This restrains the medium from being wound unevenly when the medium is wound around the winding roller.

It is preferable that in the winding apparatus, the pressing portion press a portion of the medium toward the winding roller before the winding roller winds up the portion of the medium. In accordance with this configuration, the pressing portion presses a portion of the medium toward the winding roller before the winding roller winds up this portion. Thus, air does not tend to enter between a portion of the medium that the winding roller has already wound and a portion of the medium that the winding roller is going to wind. This further restrains the medium from being wound unevenly.

It is preferable that in the winding apparatus, the pressing portion have a pressing roller that rotates on an axis extending in an axial direction of the winding roller and that presses the medium toward the winding roller.

In accordance with this configuration, the pressing roller that presses the medium rotates on its axis when the winding roller winds up the medium. This restrains the medium from being rubbed by the pressing portion (the pressing roller).

This reduces the likelihood of scratches occurring on the surface of the medium that is wound around the winding roller.

It is preferable that in the winding apparatus, the winding section support the winding roller in such a manner that the winding roller can be mounted in, and unmounted from, the winding section, and the pressing portion further include a release mechanism that causes the pressing portion to exit a state in which the pressing portion presses the medium toward the winding roller.

In the state in which the pressing portion presses the medium toward the winding roller, it tends to become difficult for a user to mount/unmount (i.e., replace) the winding roller. In accordance with this configuration, the release mechanism can cause the pressing portion to exit the above state, which enables a user to mount/unmount the winding roller easily.

It is preferable that the winding apparatus further include a tension-imparting portion and a transmission mechanism. It is also preferable that in the winding apparatus, the winding section support the winding roller in such a manner that the winding roller can be mounted in, and unmounted from, the winding section, and that the pressing portion be rotatable between a pressing position at which the pressing portion presses the medium toward the winding roller and a nonpressing position at which the pressing portion retreats from the pressing position in a direction away from the winding roller. It is also preferable that the tension-imparting portion be rotatable between a pressure application position at which the tension-imparting portion imparts tension to the medium by pressing a portion of the medium before the pressing portion presses the portion of the medium toward the winding roller and a pressure release position at which the tension-imparting portion retreats from the pressure application position in a direction away from the medium, and that when the tension-imparting portion rotates toward the pressure release position, the transmission mechanism transmit the rotation of the tension-imparting portion to the pressing portion so as to cause the pressing portion to rotate toward the nonpressing position.

When the pressing portion is positioned at the pressing position or when the tension-imparting portion is positioned at the pressure application position, it tends to become difficult for a user to mount/unmount (replace) the winding roller. In accordance with this configuration, a user rotates the tension-imparting portion toward the pressure release position so that the tension-imparting portion is positioned at the pressure release position and, at the same time, the pressing portion can be positioned at the nonpressing position. This eliminates the necessity for a user to perform two separate operations, in other words, positioning the pressing portion at the nonpressing position and moving the tension-imparting portion to the pressure release position. This can improve usability.

A printing apparatus according to another aspect of the invention includes a print section that performs printing on a long medium, and a winding apparatus that winds the medium on which printing has been performed, and the winding apparatus is a winding apparatus that has the above described configurations. In accordance with this configuration, effects similar to those obtained by the above-described winding apparatus can also be obtained in the printing apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

One embodiment of a printing apparatus equipped with a winding apparatus will be described with reference to the drawings. Note that the printing apparatus according to the present embodiment is a large format printer (LFP) of an ink jet type, which prints characters and images by ejecting ink onto a medium M, such as a long sheet of paper.

Figure 1:
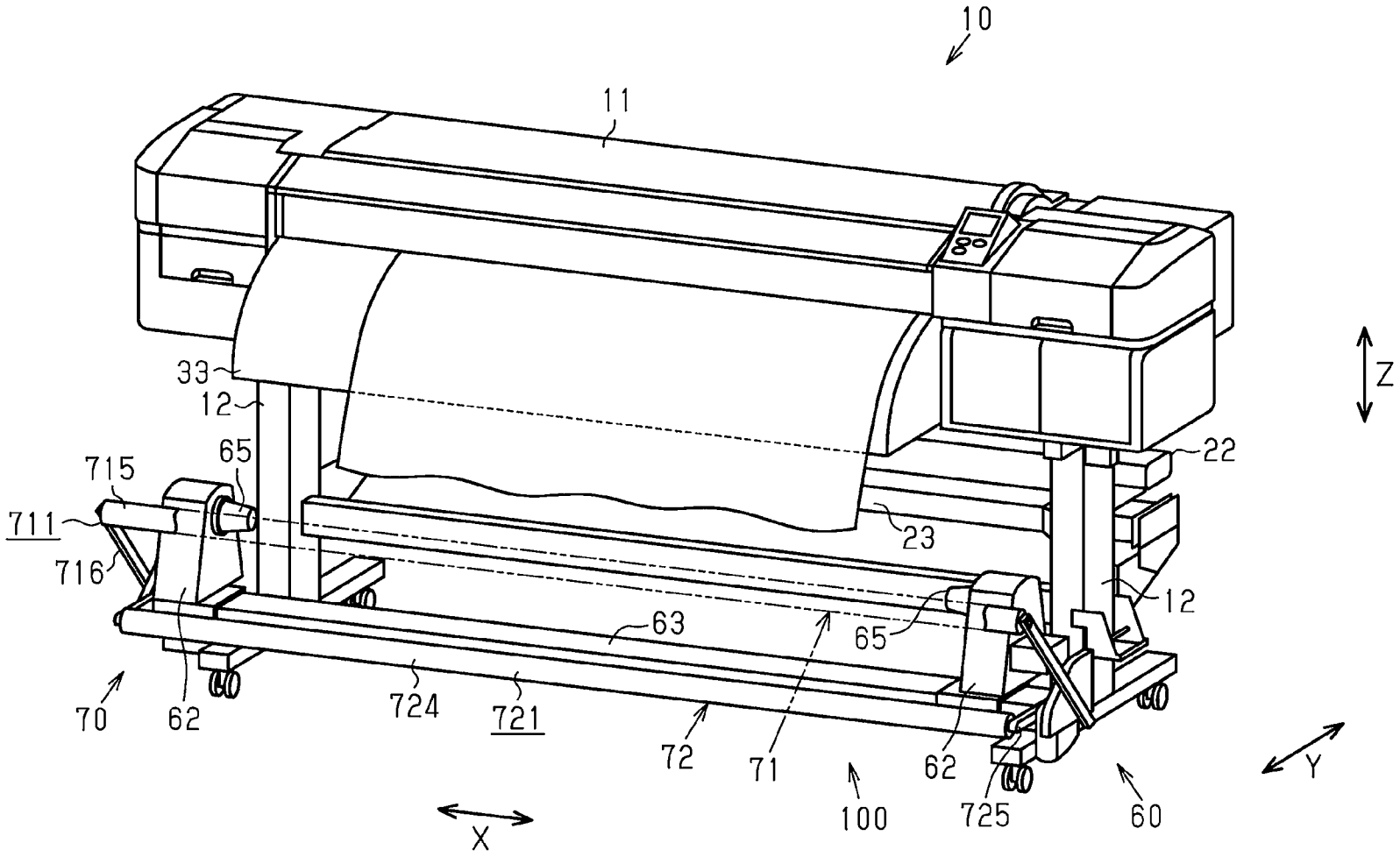
FIG. 1 is a perspective view illustrating a printing apparatus according to one embodiment.
Figure 2:
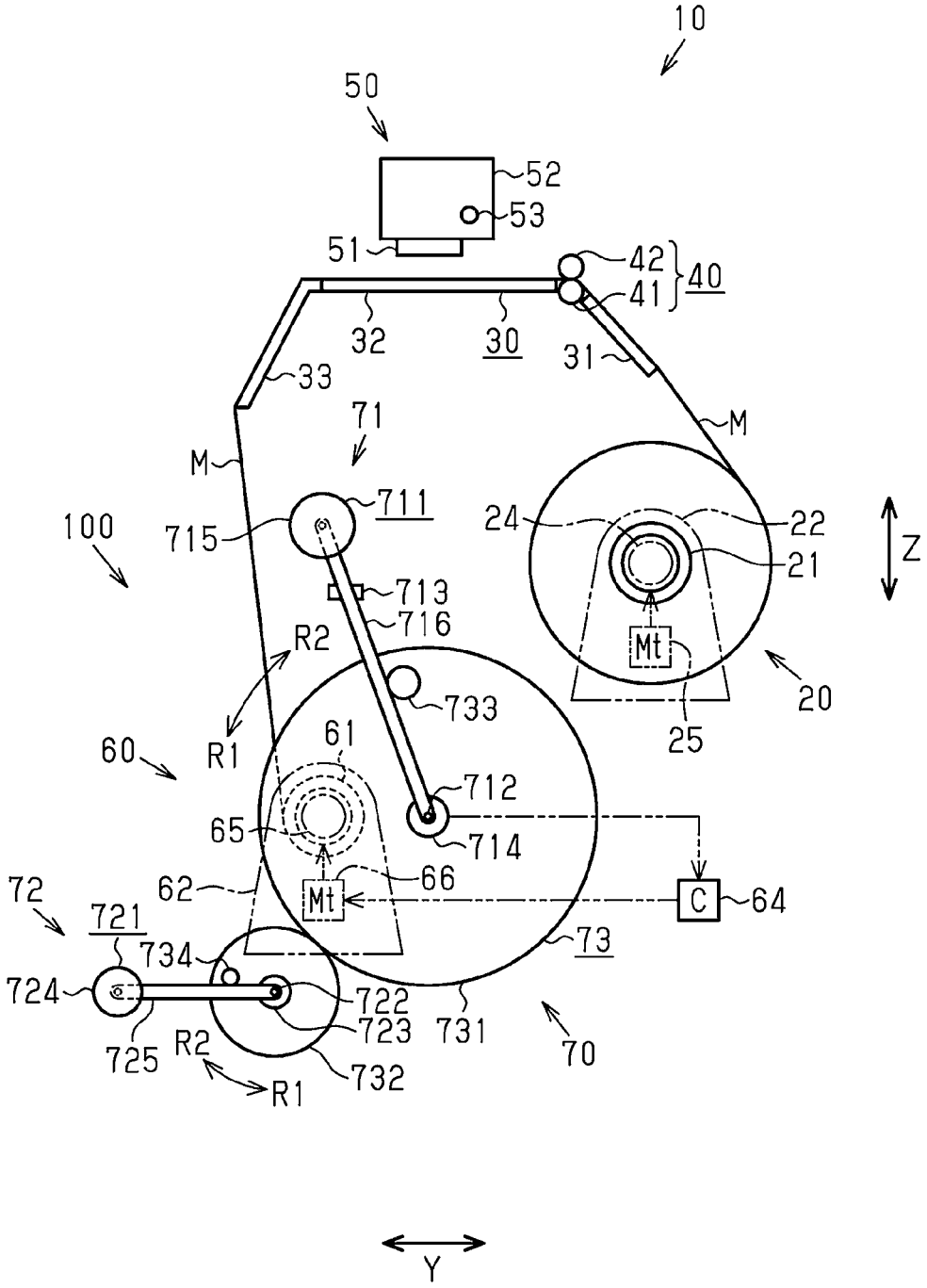
FIG. 2 is a side view illustrating a schematic structure of the printing apparatus when a winding roller is installed.

As illustrated in FIG. 1, a printing apparatus 10 includes a housing 11 that is shaped like a box and legs 12 that support the housing 11. As illustrated in FIG. 2, the printing apparatus 10 also includes, in a transport direction of a medium M, a supply section 20 that supplies a medium M that has been wound into a roll, a support section 30 that supports the medium M, a transport section 40 that transports the medium M, and a print section 50 that perform printing on the medium M. The printing apparatus 10 further includes a winding apparatus 100 that has a winding section 60 that winds the medium M into a roll and a winding aid section 70 that helps the winding section 60 to wind up the medium M.

In the following description, a left-right direction that is also a longitudinal direction of the printing apparatus 10 is referred to as "a width direction X". A depth direction of the printing apparatus 10 is referred to as "a front-rear direction Y" and an up-down direction of the printing apparatus 10 is referred to as "a vertical direction Z". Here, the width direction X, the front-rear direction Y, and the vertical direction Z intersect each other orthogonally.

As illustrated in FIGS. 1 and 2, the supply section 20 is disposed in a lower back section of the housing 11. The supply section 20 has supply units 22 that rotatably support a supply roller 21 and a guide shaft 23 that supports the supply units 22 so that the supply units 22 are movable in the width direction X. The supply roller 21 may be, for example, a tube made of paper or resin.

The supply units 22 are disposed with spacing therebetween so as to form a pair in the width direction X. As illustrated in FIG. 2, the supply units 22 have respective rotators 24 that protrude inward in the width direction X. Each of the rotators 24 is inserted into an end of the tubular supply roller 21 so that the rotators 24 and the supply roller 21 rotate together. In addition, as illustrated in FIG. 2, one of the supply units 22 that forms the pair has a supply motor 25 that rotates the rotator 24 for the one of the supply units 22. In the supply section 20, the medium M is supplied toward the support section 30 by rotating the supply roller 21 while the supply roller 21 around which the medium M is wound is mounted in the supply units 22.

As illustrated in FIG. 2, the support section 30 has a first support 31 that slants such that the medium M ascends as it proceeds in the transport direction, a second support 32 that extends horizontally, and a first support 33 that slants such that the medium M descends as it proceeds in the transport direction. The first support 31 guides the medium M supplied from the supply section 20 toward the second support 32. The second support 32 supports the medium M on which the print section 50 performs printing. The third support 33 guides the medium M on which printing has been performed toward the winding section 60.

As illustrated in FIG. 2, the transport section 40 includes a driving roller 41 disposed vertically below a transport path of the medium M and a driven roller 42 disposed vertically above the transport path of the medium M. The driving roller 41 and the driven roller 42 are disposed in such a manner that each rotation shaft is oriented in the width direction X. In the transport section 40, the medium M is transported in the transport direction by driving the driving roller 41 while the medium M is nipped by the driving roller 41 and the driven roller 42.

As illustrated in FIG. 2, the print section 50 includes an ejecting head 51 that ejects ink that is an example of a recording material, a carriage 52 that holds the ejecting head 51, and a guide shaft 53 that supports the carriage 52. The longitudinal direction of the guide shaft 53 is aligned in the width direction X. The ejecting head 51 has a plurality of nozzles that open toward the second support 32. In other words, the ejecting head 51 is a so-called "ink jet head". In the print section 50, characters and images are printed (i.e., formed) on the medium M by ejecting ink from the ejecting head 51 onto the medium M that is supported by the support section 30 while the carriage 52 moves in the width direction X.

As illustrated in FIGS. 1 and 2, the winding section 60 includes winding units 62 that rotatably support a winding roller 61, a guide shaft 63 that supports the winding units 62 so that the winding units 62 are movable in the width direction X, and a controller 64 that controls the driving of the winding units 62. The winding roller 61 may be, for example, a tube made of paper or resin.

The winding units 62 are disposed with spacing therebetween so as to form a pair in the width direction X. The winding units 62 have respective rotators 65 that protrude inward in the width direction X. Each of the rotators 65 is inserted into an end of the tubular winding roller 61 so that the rotators 65 and the winding roller 61 rotate together. In addition, one of the winding units 62 that form the pair has a winding motor 66 that rotates a corresponding rotator 65. In the winding section 60, the medium M on which printing has been performed is wound by rotating the winding roller 61 while the winding roller 61 is mounted in the winding units 62. In addition, in the winding section 60, the winding roller 61 is removed from the winding units 62 by moving each of the winding units 62 outward in the width direction X.

As illustrated in FIG. 2, the winding aid section 70 includes a tension-imparting mechanism 71 that imparts tension to the medium M, a pressing mechanism 72 that presses the medium M toward the winding roller 61, and a transmission mechanism 73 that transmits the movement of the tension-imparting mechanism 71 to the pressing mechanism 72.

As illustrated in FIG. 2, the tension-imparting mechanism 71 includes a tension-imparting portion 711 that presses the medium M from behind, rotation shafts 712 that rotatably (i.e., swingably) support the tension-imparting portion 711, a fixation device 713 that fixedly supports the tension-imparting portion 711, and a detector 714 that detects the rotation angle of the tension-imparting portion 711.

The tension-imparting portion 711 has a tension bar 715 with its longitudinal direction aligned in the width direction X and arm members 716 that support both sides of the tension bar 715 in the width direction X. The tension bar 715 preferably has a round surface so as to enable the medium M to slide smoothly thereon. For example, the tension bar 715 may be formed cylindrically. The arm members 716, which are shaped like rods, fixedly support the tension bar 715 at each top end of the arm members 716 and are rotatably supported by the rotation shafts 712 at each base end of the arm members 716.

One rotation shaft 712 is provided at each side of the tension bar 715 in the width direction X so that the rotation shafts 712 form a pair. In addition, in the side view of the printing apparatus 10, the rotation shafts 712, which are the rotation centers of the arm members 716, are positioned behind the rotation center of the winding roller 61.

The tension-imparting portion 711 rotates in a first rotation direction R1 (i.e., counterclockwise in FIG. 2) and thereby presses the medium M in a direction intersecting the transport path of the medium M so as to impart tension (a tensile force) in the transport direction to the medium M. The tension-imparting portion 711 presses a portion of the medium M before the portion of the medium M advances to the position where the pressing mechanism 72 presses the portion of the medium M toward the winding roller 61. By rotating the tension-imparting portion 711 in a second rotation direction R2 (i.e., clockwise in FIG. 2), which is opposite to the first rotation direction R1, the tension-imparting portion 711 retreats from the transport path of the medium M so as not to impart tension to the medium M. In the following description, a position at which the tension-imparting portion 711 presses the medium M is also referred to as a "pressure application position", and a position at which the tension-imparting portion 711 does not press the medium M, in other words, a position at which the tension-imparting portion 711 retreats from the transport path of the medium M (or from the medium M) (i.e., a position illustrated in FIG. 2) is also referred to as a "pressure release position".

The fixation device 713 of the tension-imparting mechanism 71 unrotatably fixes the tension-imparting portion 711 while the tension-imparting portion 711 is at the pressure release position. Note that the fixation device 713 may be, for example, a hook that hooks the tension-imparting portion 711 or a magnetic body that fixes the tension-imparting portion 711 by magnetism, or may be other devices as far as the fixation device 713 can fix the tension-imparting portion 711 at the pressure release position. In addition, the fixation device 713 may be disposed in the housing 11, in the legs 12, or in other portions.

Regarding the detector 714, a sensor that can detect the amount of rotation of the tension-imparting portion 711 can be used. The detector 714 may be, for example, a rotary encoder. The detector 714 transmits a detection signal corresponding to the rotation angle (i.e., the amount of rotation) of the tension-imparting portion 711 to the controller 64.

As illustrated in FIGS. 1 and 2, the pressing mechanism 72 includes a pressing portion 721 that presses the medium M toward the winding roller 61, rotation shafts 722 that rotatably (or swingably) support the pressing portion 721, and an urging member 723 that provides the pressing portion 721 with a moment in a direction around a rotation shaft 722.

The pressing portion 721 has a pressing roller 724 with its longitudinal direction being aligned in the width direction X and arm members 725 that support both ends of the pressing roller 724 in the width direction X. The pressing roller 724, which is shaped like a cylinder, rotates on its axis that extends in the axial direction of the winding roller 61 when the winding roller 61 is mounted in the winding section 60. The arm members 725, which are shaped like rods, rotatably support the pressing roller 724 at each top end of the arm members 725 and are rotatably supported by the rotation shafts 722 at each base end of the arm members 725.

One rotation shaft 722 is provided at each side of the pressing roller 724 in the width direction X so that the rotation shafts 722 form a pair, as are the arm members 725. In addition, in the side view of the printing apparatus 10, the rotation shafts 722, which are the center around which the pressing portion 721 rotates, are positioned below the rotation center of the winding roller 61.

The urging member 723 imparts a moment to the pressing portion 721 so that the pressing portion 721 comes closer to the winding roller 61. In other words, the urging member 723 imparts a moment to an arm member 725 in the second rotation direction R2. It is preferable that the urging member 723 be a spring such as a torsion spring or a coil spring when the urging member 723 is disposed at the base end of the arm member 725. In addition, in the case that the urging member 723 is disposed at a position distant from the base end of the arm member 725, the urging member 723 can be a helical compression spring or an extension coil spring.

When the pressing portion 721 rotates in the second rotation direction R2, the pressing portion 721 presses the medium M toward the winding roller 61. When the pressing portion 721 rotates in the first rotation direction R1, the pressing portion 721 enters a state in which the pressing portion 721 does not press the medium M toward the winding roller 61. In the following description, a position at which the pressing portion 721 presses the medium M toward the winding roller 61 is also referred to as a "pressing position", and a position at which the pressing portion 721 does not press the medium M toward the winding roller 61, in other words, a position at which the pressing portion 721 retreats from the pressing position in a direction away from the winding roller 61 (i.e., a position illustrated in FIG. 2) is also referred to as a "nonpressing position". When the pressing portion 721 is located at the pressing position, the medium M is nipped by the pressing portion 721 and the winding roller 61. Thus, the pressing position can also be referred to as a "nipped position".

In the embodiment, the pressing portion 721 is configured to press the medium M downstream of the tension-imparting portion 711 in the transport direction of the medium M, in other words, the tension-imparting portion 711 is configured to press the medium M upstream of the pressing portion 721.

In the embodiment, the more the winding roller 61 winds up the medium M, the larger the outer diameter of the winding roller 61. Thus, the position at which the pressing portion 721 presses the medium M toward the winding roller 61 varies in accordance with the amount of the medium M that has been wound around the winding roller 61. Therefore, the pressing position is not specified by a specific position but specified by a certain range of position.

A transmission mechanism 73 has a first gear 731 that is rotatably supported by a rotation shaft 712 of the tension-imparting mechanism 71 and a second gear 732 that is rotatably supported by a rotation shaft 722 of the pressing mechanism 72. The first gear 731 is supported by the rotation shaft 712 so as to rotate independently of the tension-imparting portion 711, whereas the second gear 732 is supported by the rotation shaft 722 so as to rotate independently of the pressing portion 721. In addition, the first gear 731 and the second gear 732 are disposed so as to engage each other.

A first abutment 733 protrudes from a side surface of the first gear 731. With respect to the arm member 716 of the tension-imparting portion 711, the first abutment 733 is formed on a side on the side surface in the second rotation direction R2. The first abutment 733 abuts the tension-imparting portion 711 that rotates from the pressure application position to the pressure release position, which causes the first gear 731 to rotate in the second rotation direction R2.

A second abutment 734 protrudes from a side surface of the second gear 732. With respect to the arm member 725 of the pressing portion 721, the second abutment 734 is formed on a side on the side surface in the second rotation direction R2. The second abutment 734 abuts the arm member 725 of the pressing portion 721 when the second gear 732 rotates in the first rotation direction R1, which causes the pressing portion 721 to rotate from the pressing position to the nonpressing position.

As illustrated in FIG. 2, the controller 64 controls the driving of the winding motor 66 of the winding unit 62 in accordance with the detection results of the detector 714. More specifically, the controller 64 starts or stops driving the winding motor 66 in accordance with the rotation angle of the tension-imparting portion 711. The printing apparatus 10 according to the embodiment includes a control unit that controls things related to printing, on which detailed description is omitted here. Note that the control unit that controls things related to printing and the controller 64 described above may be formed as one control unit.

Next, operation of the winding apparatus 100 (printing apparatus 10) according to the embodiment will be described with reference to FIGS. 2 to 5. Note that in FIGS. 3 to 5, the supply units 22 and the winding units 62 are omitted for clarity of illustration.

When printing is performed on a medium M in the printing apparatus 10, a supply roller 21 around which the medium M is wound is mounted in the supply section 20, and a winding roller 61 around which the medium M is not wound yet is mounted in the winding section 60. When the winding roller 61 is mounted in the winding section 60, the tension-imparting portion 711 is positioned at the pressure release position and the pressing portion 721 is positioned at the nonpressing position.

More specifically, the tension-imparting portion 711 is fixed by the fixation device 713 so as not to rotate away from the pressure release position. The arm member 716 of the tension-imparting portion 711, which is at the pressure release position, abuts the first abutment 733 of the first gear 731. The first gear 731 thereby stops in a state in which the first gear 731 rotates farthest in the second rotation direction R2 within the limits of its rotation. The second gear 732, which engages the first gear 731, also stops in a state in which the second gear 732 rotates farthest in the first rotation direction R1 within the limits of its rotation. Consequently, the second abutment 734 abuts the arm member 725 of the pressing portion 721. This causes the pressing portion 721 to rotate to the nonpressing position that is the position at which the pressing portion 721 rotates farthest in the first rotation direction R1 within the limits of its rotation. Note that the pressing portion 721 is urged to rotate in the second rotation direction R2 by an urging force of the urging member 723. However, the rotation is restrained by abutting the second abutment 734 against the arm member 725 of the pressing portion 721.

The tension-imparting portion 711 is thus positioned at the pressure release position, and the pressing portion 721 is positioned at the nonpressing position. This provides a workspace for a user to install a winding roller 61 into, or remove it from, the winding section 60. After the winding roller 61 is installed in the winding section 60, the user takes out the leading edge of a long medium M from a supply roller 21 and winds the leading edge around the winding roller 61.

Figure 3:
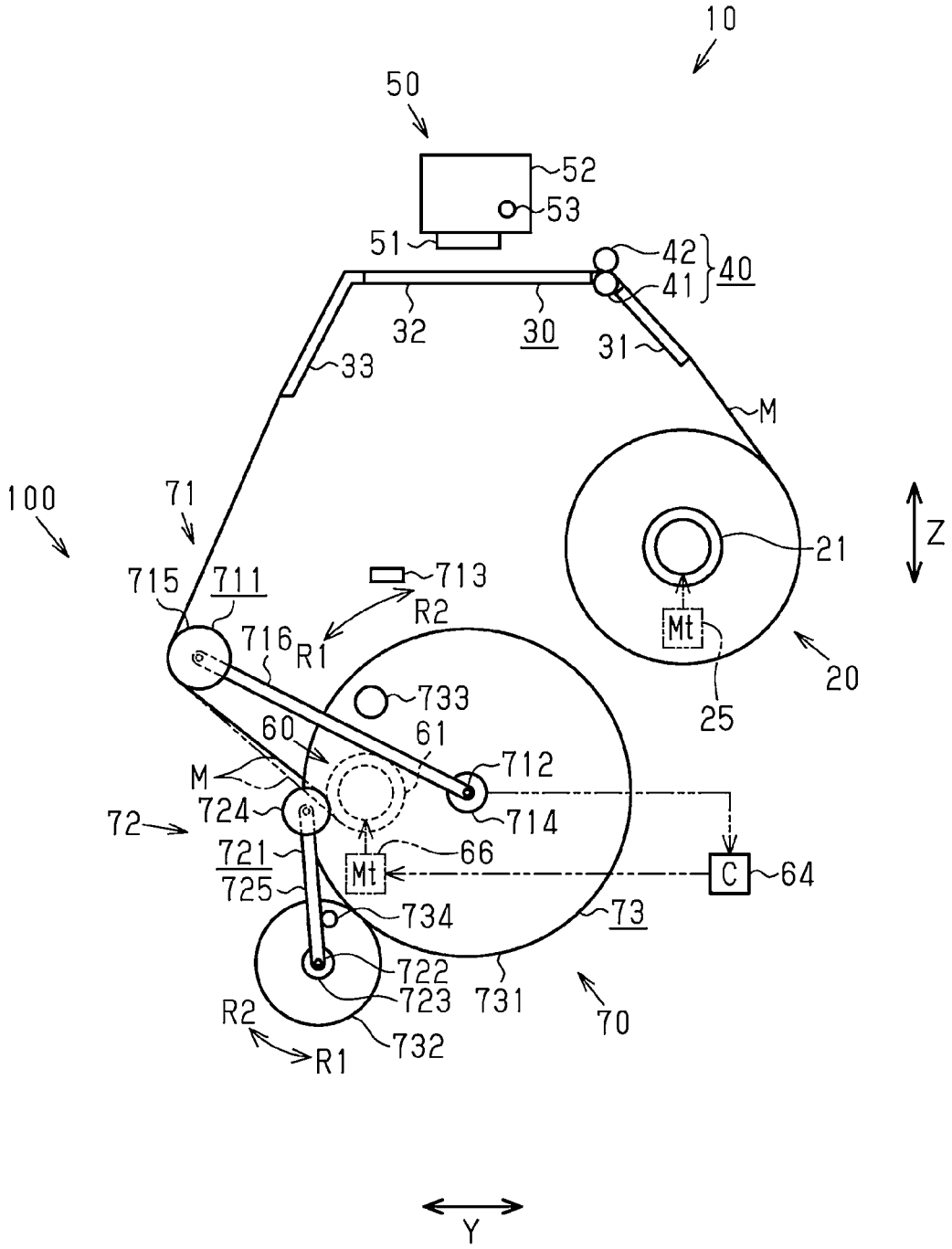
FIG. 3 is a side view illustrating a schematic structure of the printing apparatus before printing starts.

Subsequently, as illustrated in FIG. 3, the user releases the tension-imparting portion 711 from the fixation device 713, and the tension-imparting portion 711 falls by its own weight toward the front side of the printing apparatus 10. As a result, the tension-imparting portion 711 is positioned at the pressure application position. The tension-imparting portion 711 presses the medium M that stretches between the support section 30 and the winding roller 61, which causes a tensile force to act on the medium M in the transport direction.

Now that the tension-imparting portion 711 is not positioned at the pressure release position, the urging force of the urging member 723 causes the pressing portion 721 to rotate in the second rotation direction R2 from the nonpressing position toward the pressing position. As a result, the pressing portion 721 enters a state in which the pressing portion 721 presses a portion of the medium M toward the winding roller 61 before the winding roller 61 winds up this portion. Consequently, as indicated by the two-dot chain line in FIG. 3, the transport path of the medium M between the tension bar 715 and the winding roller 61 becomes shorter than the transport path before the pressing portion 721 is positioned at the pressing position.

Note that the portion of the medium M that the pressing portion 721 presses is a portion of the medium M immediately before the winding roller 61 winds up this portion. Thus, even though the pressing portion 721 that is positioned at the pressing position presses a portion of the medium M toward the winding roller 61 before the winding roller 61 winds up this portion, the transport path of the medium M between the tension bar 715 and the winding roller 61 is changed only slightly.

Note that in the case that pressing portion 721 rotates in the second rotation direction R2 from the nonpressing position toward the pressing position, the arm member 725 of the pressing portion 721 pushes the second abutment 734 of the second gear 732. This causes the second gear 732 to rotate in the second rotation direction R2, and also causes the first gear 731 to rotate in the first rotation direction R1. In the state in which the pressing portion 721 is positioned at the pressing position, the second gear 732 is in a state that the second gear 732 has rotated farthest in the second rotation direction R2 within the limits of its rotation, whereas the first gear 731 is in a state that the first gear 731 has rotated farthest in the first rotation direction R1 within the limits of its rotation. Note that in the embodiment, when the first gear 731 is in the state that it has rotated farthest in the first rotation direction R1 within the limits of its rotation, the first abutment 733 of the first gear 731 is not in contact with the arm member 716.

When the printing apparatus 10 is ready for printing as illustrated in FIG. 3, the printing apparatus 10 starts to print. The medium M that is supplied from the supply roller 21 of the supply section 20 is transported by the transport section 40 toward the support section 30, and the print section 50 subsequently ejects ink onto the medium M. Printing is thus performed. The medium M on which printing has been performed is further transported toward the winding section 60, and then the medium M is wound up in the winding section 60.

Figure 4:
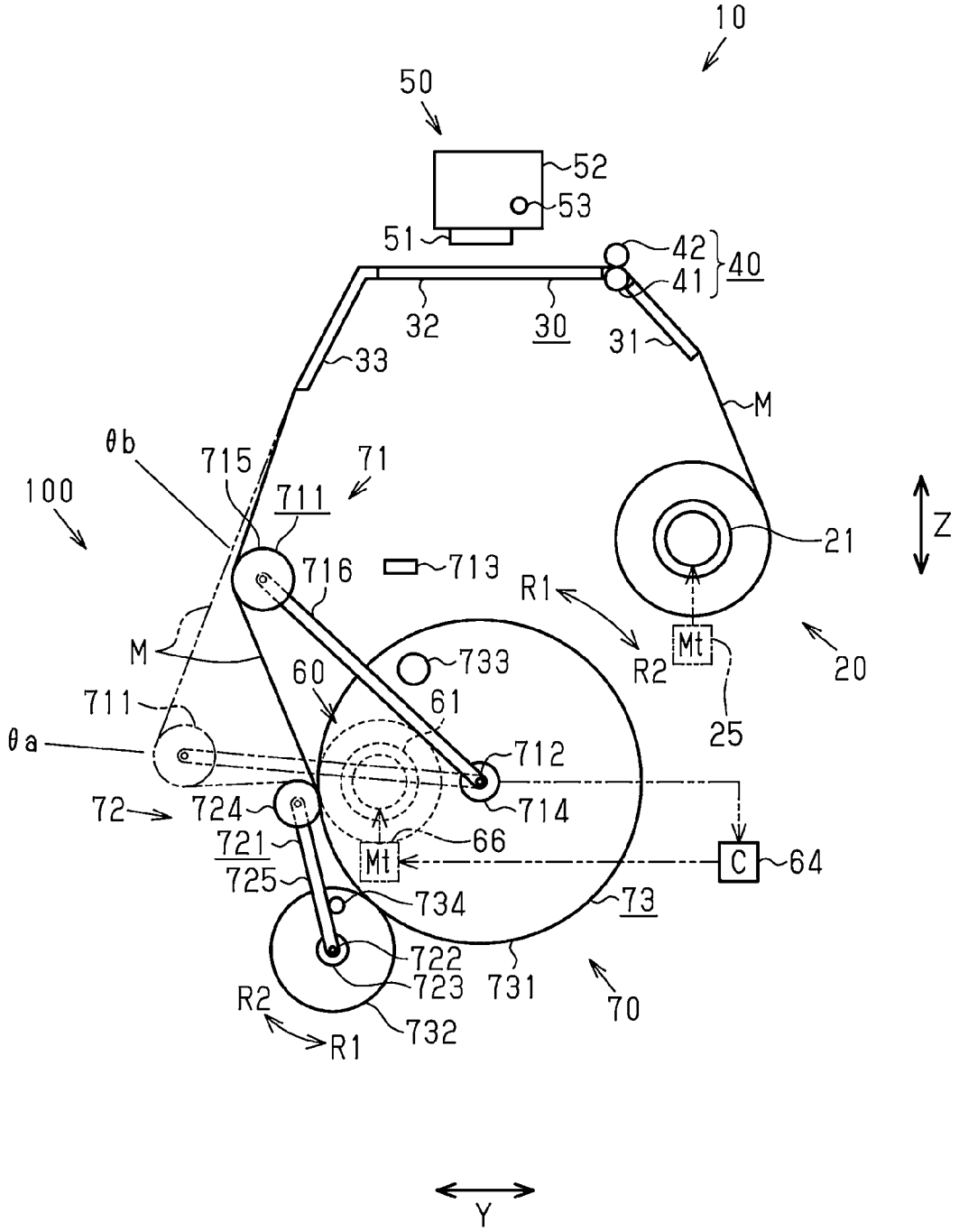
FIG. 4 is a side view illustrating a schematic structure of the printing apparatus during printing.

As indicated by the solid line and the two-dot chain line in FIG. 4, the winding section 60 intermittently performs winding of the medium M on which printing has been performed. In other words, the medium M is wound around the winding roller 61 in two processes: a first winding process in which the medium M is continuously transported in the transport direction without the medium M being wound around the winding roller 61, and a second winding process in which the medium M is wound around the winding roller 61. Note that in the second winding process, the medium M may be transported or need not be transported in the transport direction.

In the first winding process, the amount of the medium M that is transported in the transport direction exceeds the amount of the medium M that is wound around the winding roller 61. This tends to loosen the medium M between the support section 30 (the third support 33) and the winding section 60. In this case, however, the tension-imparting portion 711 rotates by its own weight in the first rotation direction R1 as shown by the two-dot chain line in FIG. 4. This restrains the medium M from loosening between the support section 30 and the winding section 60 and maintains a state in which a tensile force acts on the medium M in the transport direction.

Subsequently, when the rotation angle of the tension-imparting portion 711 reaches a winding start angle θa, the winding motor 66 is actuated to start the second winding process. As a result, the medium M is wound around the winding roller 61 with the pressing portion 721 pressing the medium M toward the winding roller 61. Thus, air does not tend to enter between a portion of the medium M that the winding roller 61 has already wound and a portion of the medium M that the winding roller 61 is winding. As a result, uneven winding does not tend to occur.

Here, the winding start angle θa is the rotation angle of the tension-imparting portion 711 when the winding roller 61 starts rotating. In other words, that the rotation angle of the tension-imparting portion 711 becomes the winding start angle θa is a condition for ending the first winding process and at the same time, a condition for starting the second winding process.

When the winding roller 61 starts winding the medium M, the length of the medium M between the support section 30 and the winding section 60 becomes smaller, which causes the tension-imparting portion 711 to rotate in the second rotation direction R2. Subsequently, when the rotation angle of the tension-imparting portion 711 reaches a winding end angle θb, as shown by the solid line in FIG. 4, the winding motor 66 stops. Thus, the winding roller 61 stops winding the medium M.

Here, the winding end angle θb is the rotation angle of the tension-imparting portion 711 when the rotation of the winding roller 61 stops. In other words, that the rotation angle of the tension-imparting portion 711 becomes the winding start angle θb is a condition for ending the second winding process and at the same time, a condition for starting the first winding process.

Thus, the medium M is wound around the winding roller 61 during printing while the first winding process and the second winding process are alternately performed. When the amount of the medium M wound around the winding roller 61 increases, the pressing portion 721 is caused to rotate in the first rotation direction R1 against the urging force of the urging member 723 so as to maintain the state in which the pressing portion 721 presses the medium M toward the winding roller 61.

Note that on the basis of the detection results of the detector 714, the controller 64 determines whether the tension-imparting portion 711 reaches the winding start angle θa and the winding end angle θb. Also note that in the embodiment, the tension-imparting portion 711 generates tension in the medium M while the tension-imparting portion 711 stays in a range between the winding start angle θa and the winding end angle θb. In this regard, the pressure application position of the tension-imparting portion 711 is a position in the range between the winding start angle θa and the winding end angle θb.

Figure 5:
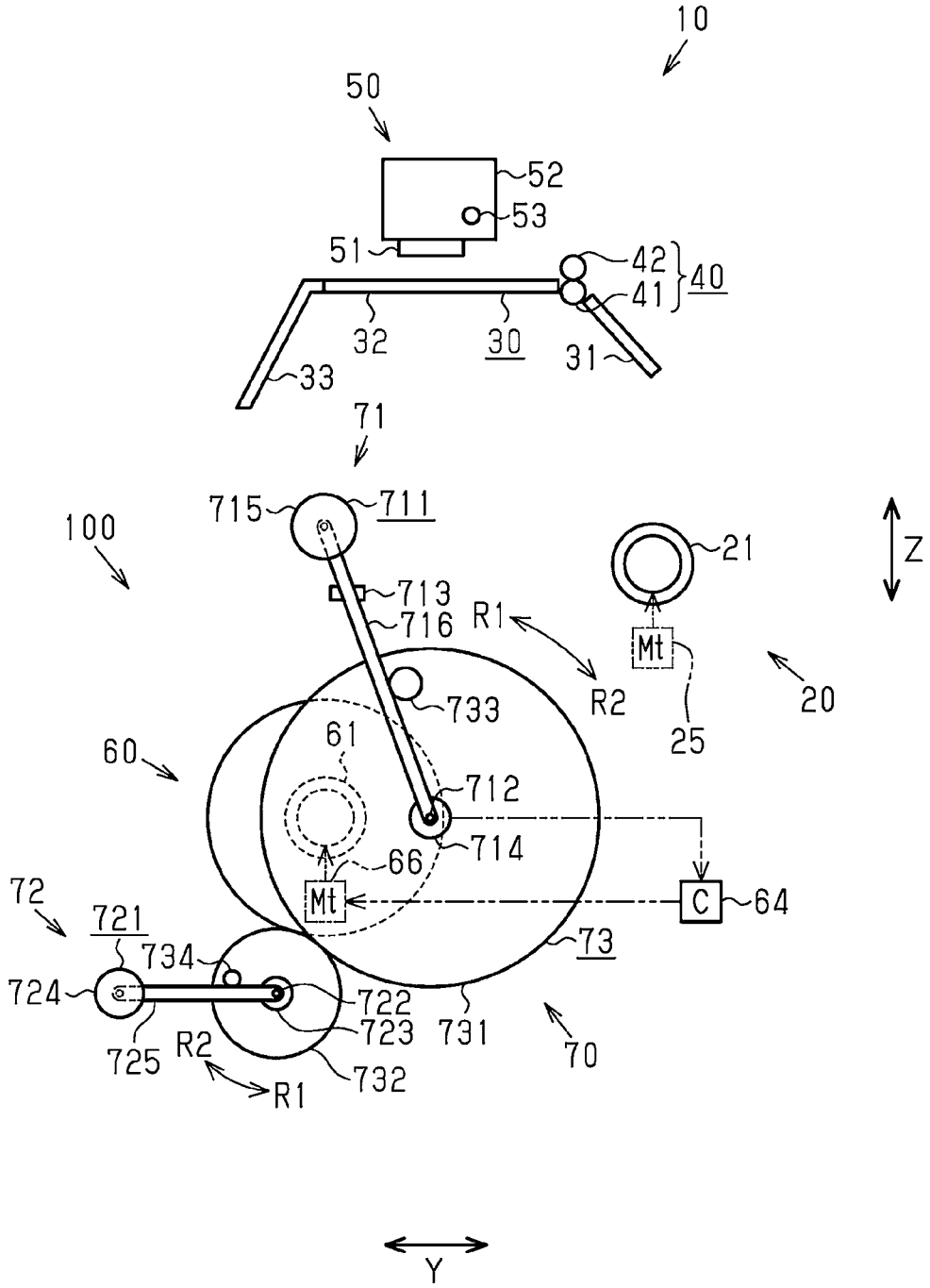
FIG. 5 is a side view illustrating a schematic structure of the printing apparatus when the winding roller is removed.

As illustrated in FIG. 5, when printing is completed for all the medium M that has been wound around the supply roller 21 or when all the print jobs that have been input in the printing apparatus 10 are completed, the supply roller 21 may be removed from the supply section 20 or the winding roller 61 may be removed from the winding section 60.

When the winding roller 61 is removed from the winding section 60, a user rotates the tension-imparting portion 711 in the second rotation direction R2 so as to position the tension-imparting portion 711 at the pressure release position. The arm member 716 of the tension-imparting portion 711 pushes the first abutment 733 of the first gear 731, which causes the first gear 731 to rotate in the second rotation direction R2. The second gear 732 that engages the first gear 731 rotates in the first rotation direction R1. The second abutment 734 thereby causes the pressing portion 721 to rotate in the first rotation direction R1. As a result, the second gear 732 is positioned at the nonpressing position. Consequently, a workspace is provided for a user to remove the winding roller 61 from the winding section 60.

In the embodiment, moving the tension-imparting portion 711 from the pressure application position to the pressure release position causes the pressing portion 721 to move from the pressing position to the nonpressing position. In this regard, the transmission mechanism 73 (the first gear 731 and the second gear 732) is an example of a "release mechanism" that causes the pressing portion 721 to exit the state in which the pressing portion 721 presses the medium M toward the winding roller 61.

In accordance with the above embodiment, effects described below can be obtained. The pressing portion 721 presses the medium M toward the winding roller 61 that winds up the medium M. As a result, air does not easily enter between layers of the medium M that has been wound around the winding roller 61. This restrains the medium M from being wound unevenly when the medium M is wound around the winding roller 61.

The pressing portion 721 presses a portion of the medium M toward the winding roller 61 before the winding roller 61 winds up this portion. Thus, air does not tend to enter between a portion of the medium M that the winding roller 61 has already wound and a portion of the medium M that the winding roller 61 is going to wind. This further restrains the medium M from being wound unevenly when the medium M is wound around the winding roller 61.

The pressing roller 724 rotates when the winding roller 61 winds up the medium M. This restrains the medium M from being rubbed by the pressing portion 721 (the pressing roller 724). This reduces the likelihood of scratches occurring on the surface of the medium M that is wound around the winding roller 61.

In a state in which the pressing portion 721 presses the medium M toward the winding roller 61, it tends to become difficult for a user to mount/unmount (i.e., replace) the winding roller 61. In accordance with the embodiment, by positioning the pressing portion 721 at the nonpressing position, the pressing portion 721 can exit the state in which the pressing portion 721 presses the medium M toward the winding roller 61. This allows a user to mount/unmount the winding roller 61 easily.

When the pressing portion 721 is positioned at the pressing position or when the tension-imparting portion 711 is positioned at the pressure application position, it tends to become difficult for a user to mount/unmount the winding roller 61. In accordance with the embodiment, a user can rotate the pressing portion 721 to the nonpressing position by rotating the tension-imparting portion 711 toward the pressure release position. This eliminates the necessity for a user to perform two separate operations, in other words, positioning the pressing portion 721 at the nonpressing position and moving the tension-imparting portion 711 to the pressure release position. This can improve usability.

Note that the embodiments described above may be modified as below. The transmission mechanism 73 may be a transmission mechanism 73 that is constituted by three or more gears. The pressing portion 721 may press a portion of the medium M toward the winding roller 61 after the winding roller 61 winds up this portion.

The winding apparatus 100 need not include the transmission mechanism 73. In this case, an actuator such as a motor may rotate the tension-imparting portion 711 and the pressing portion 721, or a user may rotate them manually.

The pressing portion 721 may move between the pressing position and the nonpressing position in a manner other than rotation. Similarly, the tension-imparting portion 711 may move between the pressure application position and the pressure release position in a manner other than rotation.

A plurality of pressing rollers 724 of the pressing portion 721 may be disposed with spacing between each other in the width direction X. The pressing portion 721 need not include the pressing roller 724. In this case, it is preferable that the pressing portion 721 have a pressing plate with its longitudinal direction being aligned in the width direction X.

The detector 714 that detects the winding start angle θa and the winding end angle θb need not be a rotary encoder. For example, the detector 714 may be a contact type detector that detects the winding start angle θa and the winding end angle θb by coming into contact with the arm member 716 of the tension-imparting portion 711 when the arm member 716 is positioned at the winding start angle θa and the winding end angle θb.

The winding apparatus 100 need not include a tension-imparting device. In this case, it is preferable that the winding apparatus 100 continuously wind the medium M around the winding roller 61. The winding apparatus 100 may be used in a processing apparatus that performs processing, such as cutting, etc., on a sheet-type medium M.

The medium M may be a sheet of fiber material, leather or plastic film as well as a sheet of paper. The ejecting head 51 may be a so-called line head that has a nozzle row having a length more than that of the medium M in the width direction X and that is fixedly disposed in the printing apparatus 10.

In the embodiment described above, a recording material to be used in printing may be a fluid rather than ink (fluid including liquid, a liquid-state material made by dispersing or mixing particles of a functioning material in liquid, a fluid-state material such as a gel, or a solid that can flow and be ejected as a fluid). The printing apparatus 10 may be configured to perform recording by ejecting a liquid-state material that contains, in the form of a dispersion or melt, an electrode material, a coloring material (pixel material), etc., to be used for manufacturing liquid crystal displays, Electro Luminescence (EL) displays, surface light emission displays, etc.

In the above embodiments, the printing apparatus 10 is not limited to a printer that performs recording by ejecting ink, but may be, for example, a non-impact printer, such as a laser printer, an LED printer, or a thermal transfer printer (including a dye sublimation printer), or may be impact printer, such as a dot-impact printer.

This application claims priority under 35 U.S.C. § 119 to Japanese Patent Application No. 2016-205372, filed Oct. 19, 2016. The entire disclosure of Japanese Patent Application No. 2016-205372 is hereby incorporated herein by reference.

What is claimed is:

1. A winding apparatus, comprising:

a winding section that has a winding roller rotatably supported therein and winds a long medium around the winding roller; and a pressing portion that presses the medium toward the winding roller when placed in a pressing position and that does not press the medium toward the winding roller when placed in a nonpressing position;

a tension-imparting portion; and a transmission mechanism, wherein:

the winding section supports the winding roller and the winding roller is configured to be mounted in, and unmounted from, the winding section, the pressing portion is rotatable between the pressing position and the nonpressing position at which the pressing portion retreats from the pressing position in a direction away from the winding roller, the tension-imparting portion is rotatable between a pressure application position at which the tension-imparting portion imparts tension to the medium by pressing a portion of the medium before the pressing portion presses the portion of the medium toward the winding roller and a pressure release position at which the tension-imparting portion retreats from the pressure application position in a direction away from the medium, and when the tension-imparting portion rotates toward the pressure release position, the transmission mechanism transmits the rotation of the tension-imparting portion to the pressing portion so as to cause the pressing portion to rotate toward the nonpressing position.

2. The winding apparatus according to claim 1, wherein the pressing portion presses a portion of the medium toward the winding roller before the winding roller winds up the portion of the medium.

3. The winding apparatus according to claim 1, wherein the pressing portion has a pressing roller that rotates on an axis extending in an axial direction of the winding roller and that presses the medium toward the winding roller.

4. The winding apparatus according to claim 1, wherein the pressing portion further includes a release mechanism that causes the pressing portion to exit the pressing position in which the pressing portion presses the medium toward the winding roller.

5. A printing apparatus, comprising:

a print section that performs printing on a long medium; and a winding apparatus that winds the medium on which printing has been performed, wherein the winding apparatus is a winding apparatus according to claim 1.

6. A printing apparatus, comprising:

a print section that performs printing on a long medium; and a winding apparatus that winds the medium on which printing has been performed, wherein the winding apparatus is a winding apparatus according to claim 2.

7. A printing apparatus, comprising:

a print section that performs printing on a long medium; and a winding apparatus that winds the medium on which printing has been performed, wherein the winding apparatus is a winding apparatus according to claim 3.

8. A printing apparatus, comprising:

a print section that performs printing on a long medium; and a winding apparatus that winds the medium on which printing has been performed, wherein the winding apparatus is a winding apparatus according to claim 4.

* * * * *